United States Patent [19]

Kamohara et al.

[11] Patent Number: 4,472,321

[45] Date of Patent: Sep. 18, 1984

[54] ALTITUDE COMPENSATION APPARATUS FOR CARBURETOR

[75] Inventors: Tatsuyoshi Kamohara; Hidemi Oonaka, both of Susono, Japan

[73] Assignee: Toyota Jidosha Kabushiki Kaisha, Japan

[21] Appl. No.: 417,908

[22] Filed: Sep. 14, 1982

[30] Foreign Application Priority Data

Nov. 6, 1981 [JP] Japan ..... 56-177253
Mar. 30, 1982 [JP] Japan ..... 57-50055

[51] Int. Cl.[3] ..... F02M 7/24

[52] U.S. Cl. ..... 261/39 A; 261/121 B; 261/DIG. 74

[58] Field of Search ..... 261/121 B, 39 A, DIG. 74

[56] References Cited

U.S. PATENT DOCUMENTS

| | | | |
|---|---|---|---|
| 2,342,975 | 2/1944 | Shaff | 261/121 B |
| 3,810,606 | 5/1974 | Masaki | 261/121 B |
| 3,861,366 | 1/1975 | Masaki et al. | 261/121 B |
| 3,906,910 | 9/1975 | Szlaga, Jr. | 261/121 B |
| 3,925,521 | 12/1975 | Otani | 261/121 B |
| 3,987,131 | 10/1976 | Hisatomi et al. | 261/121 B |
| 4,119,074 | 10/1978 | Masaki | 261/121 B |
| 4,148,848 | 4/1979 | Ogita | 261/121 B |
| 4,173,956 | 11/1979 | Ikeura et al. | 261/121 B |
| 4,177,224 | 12/1979 | Yamanaka et al. | 261/121 B |

FOREIGN PATENT DOCUMENTS

| | | | |
|---|---|---|---|
| 2056706 | 5/1973 | Fed. Rep. of Germany | 261/121 B |
| 55-134740 | 10/1980 | Japan | 261/121 B |

*Primary Examiner*—Tim R. Miles
*Attorney, Agent, or Firm*—Finnegan, Henderson, Farabow, Garrett & Dunner

[57] ABSTRACT

An altitude compensation device for a carburetor including a chamber in communication with the atmosphere, an air bleed port conducting atmosphere from the chamber, a primary conduit providing fluid communication between the chamber and the fuel system of the carburetor, a first valve responsive to changes in atmospheric pressure for opening and closing the air bleed port, a first flow restrictor in the primary conduit downstream of the air bleed port, an auxiliary conduit providing fluid communication between an atmospheric pressure source and the primary conduit at a junction downstream of the flow restrictor and upstream of the carburetor fuel system, a second valve responsive to changes in atmospheric pressure controlling communication between the auxiliary conduit and the atmospheric pressure source, a second flow restrictor in the auxiliary conduit downstream of the atmospheric pressure source and upstream of the junction with the primary conduit, and a thermosensitive valve responsive to engine temperature permitting communication with the atmosphere through the auxiliary conduit when engine temperature is below a predetermined level and preventing communication with the atmosphere through the auxiliary conduit when engine temperature is above the predetermined level.

19 Claims, 10 Drawing Figures

PRIOR ART

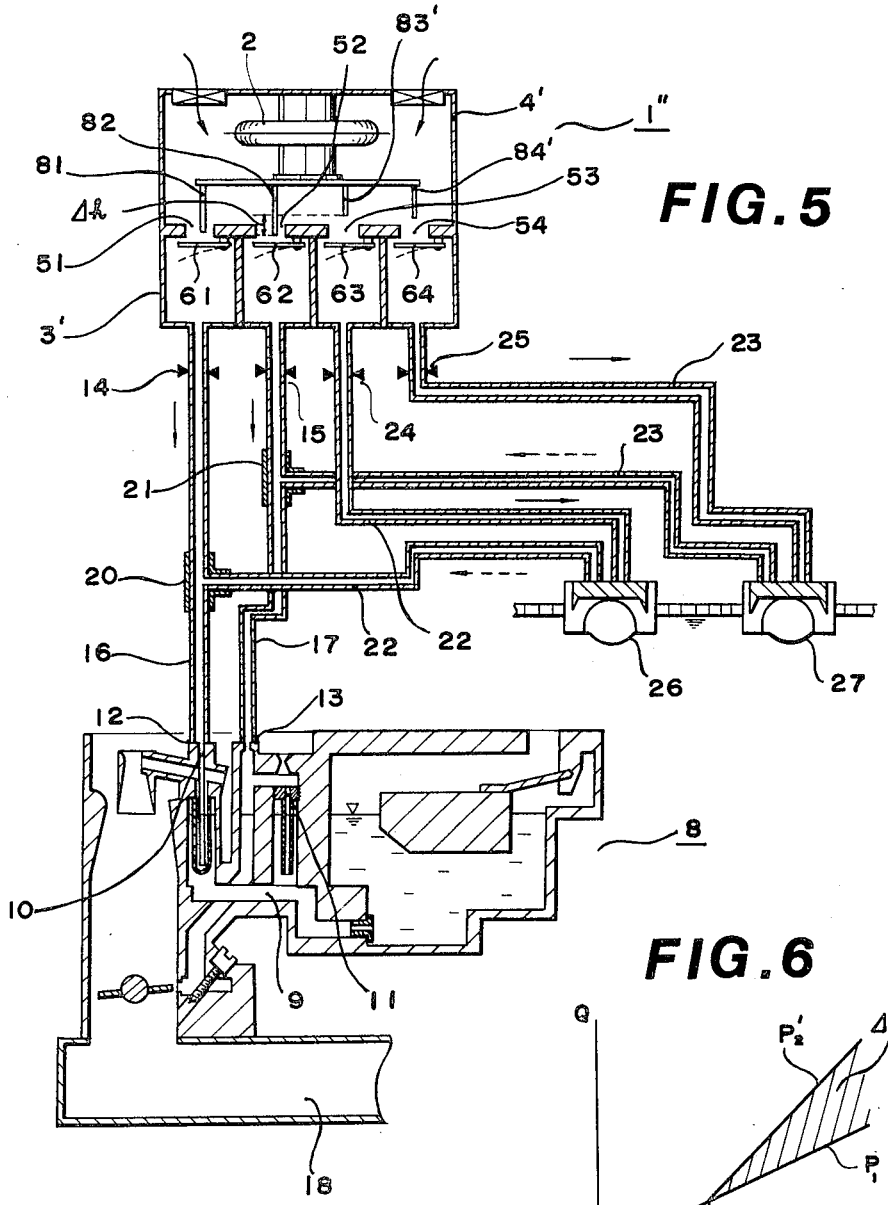
FIG. 5
FIG. 6
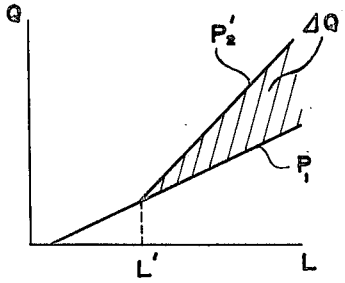

ALTITUDE COMPENSATION APPARATUS FOR CARBURETOR

BACKGROUND OF THE INVENTION

1. Field of the Invention

This invention relates to an altitude compensation apparatus for a carburetor to be connected to the main body of a bleed air compensation apparatus which includes passages having set throttles and communicated with a primary main air bleed port and a slow air bleed port disposed in the fuel passage of the carburetor of a car engine, and bellows containing air so that additional bleed air is supplied to cope with the lean air at high altitudes. More particularly, the present invention relates to an altitude compensation apparatus for a carburetor having a construction in which operation rods are fitted to the bellows of the main body of said compensation apparatus; a plurality of flow rate control valves are opened and closed by a vacuum corresponding to the altitude; the passage is opened and closed by the flow rate control valves; and thermosensitive operation valves for sensing when the engine is cold and after it has warmed up are interposed in auxiliary passages branched from the passage so as to ensure an increased air bleed quantity in driving with the engine being yet cold.

2. Description of the Prior Art

As is well known, a car is very mobile and can move from low altitudes such as along coastal regions to high altitudes such as in the mountains. Hence, the air density in the air-fuel mixture supplied by a carburetor to the engine is likely to become rich due to the pressure change when the car moves from low to high altitudes. In other words, the air-fuel ratio becomes lower in the highlands than in the lowlands.

Accordingly, an altitude compensation apparatus is generally disposed in order to provide a constant air-fuel ratio and ensure stable engine operation irrespective of the altitude difference (pressure difference).

The conventional altitude compensation apparatus 1 will be briefly described with reference to FIG. 1. The bellows 2, into which the set reference atmospheric pressure is sealed, are disposed inside the casing 4 of the main body of the compensation apparatus and detect the pressure change due to the altitude difference. The bellows 2 contract at low altitudes and a fixed valve 6 which is integral with the bellows closes a bleed port 5, thereby cutting off the air from an air filter 7. Accordingly, the bleed air is not delivered to passages 16 and 17 that have fixed throttles 14 and 15 and are communicated with a primary main air bleed 10 of the fuel passage 9 of the carburetor 8, a primary main air bleed port 12 of a slow air bleed port 11, and a slow air bleed port 13 so that the air-fuel mixture is distributed at a set air-fuel ratio to each cylinder via an intake manifold 18. In high altitudes, on the other hand, the bellows 2 expands and the fixed valve 6 opens the bleed port 5 so that air from the air filter 7 is delivered to the primary main air bleed port 10 and the slow air bleed port 11 through the passages 16 and 17. Thus, the quantity of bleed air is increased from that in low altitudes while the quantity of fuel is decreased, thereby preventing the air-fuel ratio from becoming over-rich in at high altitudes.

In the conventional altitude compensation apparatus 1 described above, however, the throttles 14 and 15 are disposed in such a manner that the quantity of bleed air is controlled in accordance with the pressure difference resulting from the altitude difference, irrespective of the engine temperature. Accordingly, if the engine operates suitably after it is warmed-up, the quantity of bleed air is likely to be insufficient when the engine is cold because the choke is cold, the air-fuel ratio is too rich and the like. Especially when the engine is cold at higher altitudes, the air-fuel ratio is most likely to be too rich so that driving performance deteriorates, and the exhaust gas is insufficiently processed and purified.

SUMMARY OF THE INVENTION

It is a first object of the present invention to provide an altitude compensation apparatus to be mounted on the carburetor which eliminates the problem with the prior art in that the bleed air is likely to be insufficient when the engine is cold at high altitudes.

It is a second object of the present invention to provide an altitude compensation apparatus in which auxiliary passages equipped with thermosensitive operation valves are disposed in passages with fixed throttles for setting the quantity of bleed air after the engine is warmed up to be communicated with the air bleed ports of the intake system of the carburetor; flow rate control valves are disposed in the auxiliary passages so that the altitude can be compensate for by bellows charged with atmospheric pressure; and flow rate control valves or vacuum control change-over valves are communicated with the auxiliary passages in order to promote the air bleed step-wise or without steps in cold operation at high altitudes.

In short, the present invention is directed to provide an excellent altitude compensation apparatus for carburetors, that can be advantageously utilized in carburetors in the automobile industry.

BRIEF DESCRIPTION OF THE DRAWINGS

FIG. 5 is a sectional view of a second embodiment and corresponds to FIG. 2;

FIG. 6 is a diagram of the air bleed characteristics of the second embodiment;

DESCRIPTION OF THE PREFERRED EMBODIMENTS

Figure 1:
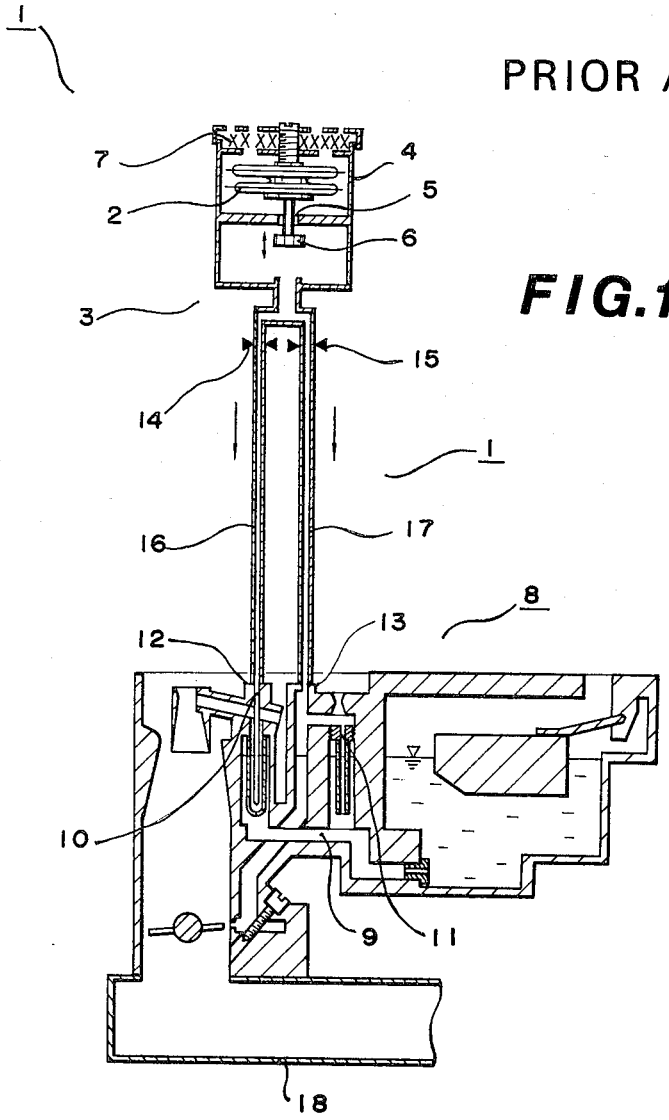
FIG. 1 is a sectional view of the conventional altitude compensation apparatus.

Hereinafter, the preferred embodiments of the present invention will be described with reference to FIGS. 2 through 10, in which the same reference numerals are used to identify the same elements shown in FIG. 1.

Figure 2:
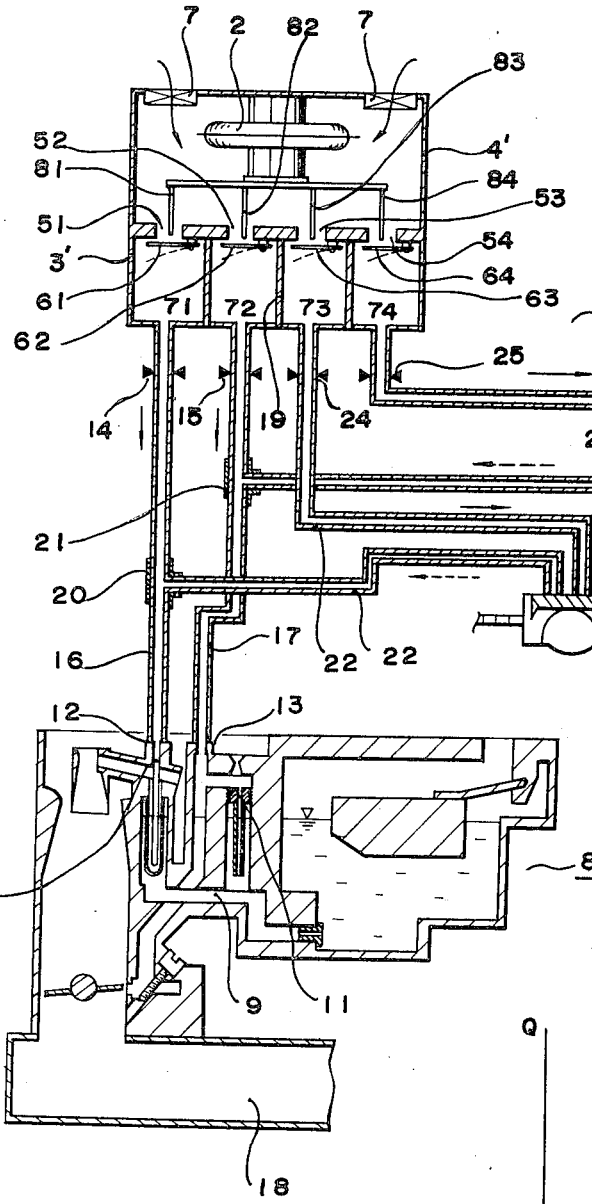
FIG. 2 is a sectional view of a first embodiment of the present invention.
Figure 3:
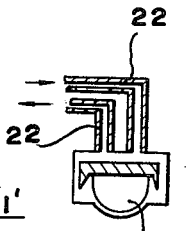
FIG. 3 is a sectional view of the thermosensitive operation valve of the first embodiment after engine warm-up.
Figure 4:
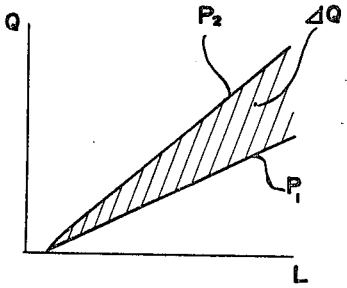
FIG. 4 is a diagram showing the air bleed characteristics of the first embodiment.

In the first embodiment shown in FIGS. 2, 3 and 4, reference numeral 1' represents the altitude compensation apparatus in accordance with the first embodiment of the present invention. Air filters 7, 7 are disposed on a casing 4' of the main frame 3' of the altitude compensation apparatus mounted on the carburetor 8 and are communicated with the atmosphere. Bellows 2, into which the reference atmospheric pressure is charged, are disposed inside the casing 4'. The base portion of the bellows is fixed while the tip is equipped with operation rods 81, 82, 83, 84 that are integrally formed with and fixed to the tip so as to confront bleed ports 51, 52, 53, 54 of valve chambers 71, 72, 73, 74 defined by partition walls 19, 19 . . . , respectively, and have the same length.

Lead valves 61, 62, 63, 64 are fixed by screws to the bleed ports 51, 52, 53, 54, respectively, and function as flow control valves of an elastic sheet opening and closing on the side opposite to the bellows 2. These valves are continuously opened by the corresponding operation rods 81, 82, 83, 84 and are closed by spring-back.

Fixed throttles 14 and 15 for limiting the maximum flow rate are inserted in passages 16 and 17 communicating between the primary main air bleed port 12 of the primary main air bleed 10 of the fuel passage 9 of the known carburetor 8 and the valve chamber 71, and between the slow air bleed port 13 of the slow air bleed 11 of the fuel passage 9 and the valve chamber 72, respectively. Auxiliary passages 22 and 23 are branched from trident branch joints 20 and 21 of passages 16 and 17 and are connected to valve chambers 73, 74, respectively. The auxiliary passages 22 and 23 have throttles 24 and 25 for restricting the maximum flow rate and bimetal-type thermosensitive operation valves 26 and 27 are inserted into these passages.

Incidentally, the abovementioned fixed throttles 14, 15 and throttles 24, 25 need not be necessary, depending upon the design of the apparatus.

The thermosensitive operation valves 26 and 27 are constructed in such a manner as to automatically open the auxiliary passages 22 and 23 in response to the temperature when the engine cooling water temperature is below a set temperature (when the engine is cold), as shown in FIGS. 2 and 3, for example.

When the temperature is higher than the set temperature or when the engine is warmed up, the valves cut off the auxiliary passages 22 and 23.

In the above-mentioned construction, the bellows 2 is contracted at low altitude so that all the operation rods 81 through 84 are kept drawn back and all the lead valves 61 through 64 close the bleed ports 51 through 54 of the main body 3' of the compensation apparatus by spring-back. Accordingly, the altitude compensation apparatus 1' does not send the bleed air to the main air bleed port 12 and slow air bleed port 13 of the carburetor 8 whether the engine is warm or cold. Hence, the engine is operated at the set air-fuel ratio for low altitude and drivability as well as processing of the exhaust gas becomes stable.

On the other hand, when the car moves to higher altitudes, the bellows 2 expands in response to the altitude, or in response to the low pressure at the high place, and its operation rods 81 through 84 continuously push and open the lead valves 61 through 64 and determine the open area of the passages 16 and 17 by means of the lead valves 61 through 64 and the bleed ports 51 through 54, though the engine is hot.

Since the thermosensitive valves 26 and 27 close the passages 22 and 23 after the engine is warmed up, the air is bled in a flow rate corresponding substantially to the open area of the bleed ports 51 and 52.

The thermosensitive valves 26 and 27 open the auxiliary passages 22 and 23 as shown in FIG. 3 when the engine is cold, at a temperature below the set temperature, and the air is increased in an amount corresponding to the increment of the bleed air fed from the main body 3' of the compensation apparatus via the bleed ports 53 and 54, thereby compensating for the closing of the choke due to the cold and setting the air-fuel ratio to the set cold air-fuel ratio. Hence, the air-fuel ratio does not become over-rich and the engine can be stably driven cold and the exhaust gas can be stably treated.

FIG. 4 shows the characteristics of the quantity of bleed air. The altitude L is plotted on the abscissa and the bleed air quantity Q is plotted, on the ordinate. After the engine is warmed up, the characteristics become such as represented by P1, and when the engine is cold the characteristics are such as represented by P2. In other words, air bleed characteristics having an increment $\Delta Q$ can be obtained.

In this manner, the engine can be driven cold, and the engine warm-up proceeds. When the set temperature is reached, or driving shifts to driving with the hot engine, the thermosensitive operation valves 26 and 27 assume the state shown in FIG. 2 and cut off the auxiliary passages 22 and 23. Accordingly, even when the lead valves 63 and 64 are open, no bleed air is applied to these passages and the air bleed characteristics shift to P1 of FIG. 4 so that the air bleed for high altitudes after the engine is warmed up is in effect, and both drivability and treatment of the exhaust gas are stable.

In the altitude compensation apparatus 1" in the second embodiment of the invention shown in FIGS. 5 and 6, the operation rods 83' and 84', which have the same length, for lead valves 63 and 64 opposing the auxiliary passages 22 and 23 are shorter by $\Delta h$ than the operation rods 81 and 82, which have the same length, for the lead valves 61 and 62 for the passages 16 and 17 so that the degree of altitude compensation in driving with the engine cold becomes higher by L' than the ordinary degree of altitude compensation, as shown in FIG. 6. The design may be modified by lowering the corresponding valves 63 and 64 together with their valve seats.

Figures 7, 8:
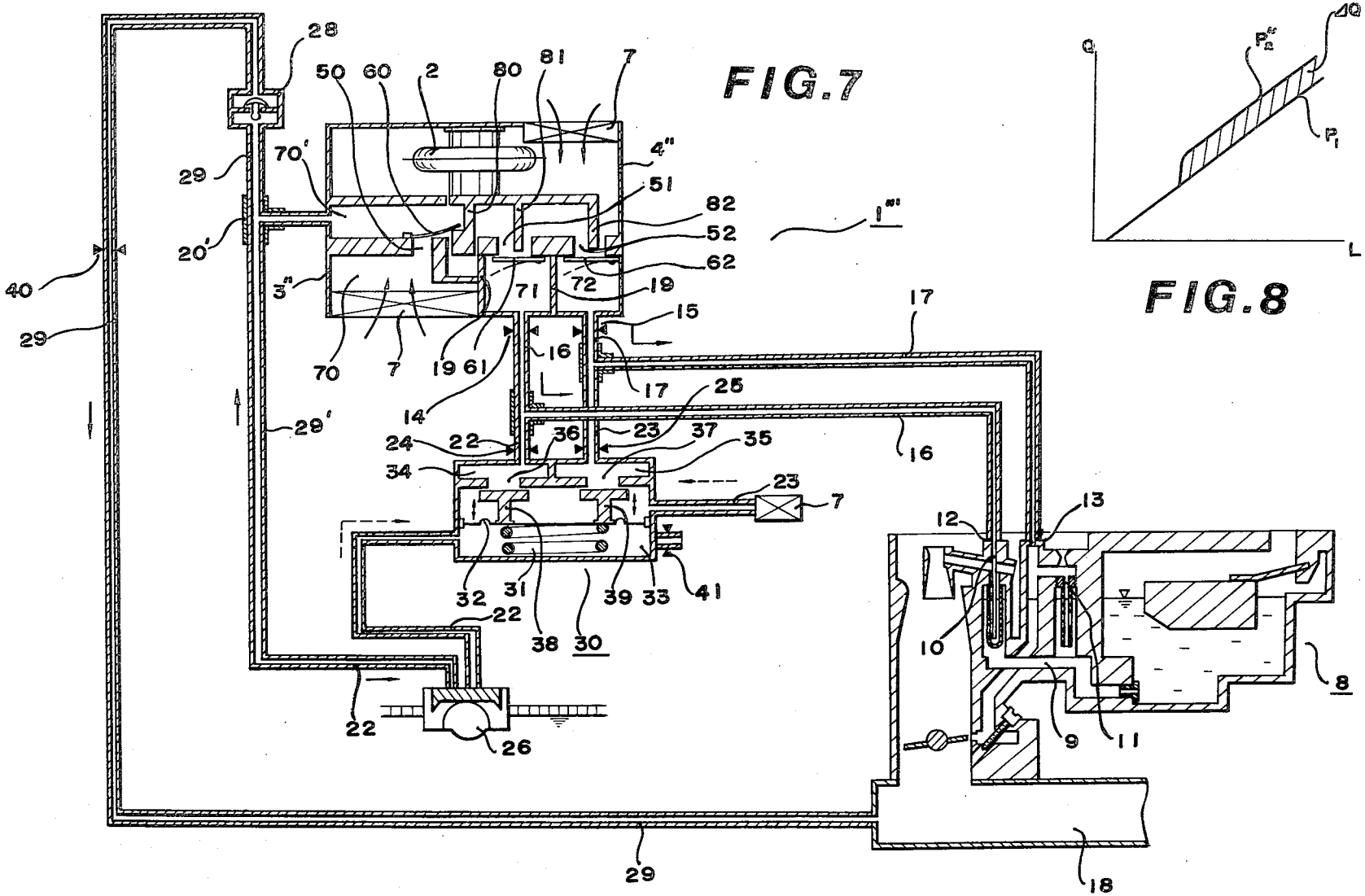
FIG. 7 is a sectional view of a third embodiment.
FIG. 8 is a diagram of the air bleed characteristics of the third embodiment.

In the third embodiment of the invention shown in FIGS. 7 and 8, the altitude compensation apparatus 1''' has operation rods 81 and 82 for the lead valves 61 and 62 of the valve chambers 71 and 72 connected to the passages 16 and 17 for the primary main air bleed port 12 and to the slow air bleed port 13 of the carburetor 8, respectively. The apparatus 1''' also has the operation rod 80 anchored from below to the upper lead valve 60 for opening and closing the communication port 50 interposed between an atmospheric chamber 70 and a vacuum chamber 70'.

The vacuum chamber 70' is communicated with intake manifold 18 downstream of the carburetor 8 by a vacuum passage 29 having a check valve 28, via the trident branch joint 20'. It is also communicated with a vacuum chamber 33, which is defined by a diaphragm 32 and a spring 31 of a vacuum control change-over valve 30, via vacuum passage 29'. The thermosensitive operation valve 26 is interposed at an intermediate portion of passage 29'.

The auxiliary passages 22 and 23 are communicated with passages 16 and 17 via the throttles 24 and 25, respectively, and are communicated with the air filter 7 via the above-mentioned vacuum control change-over valve 30.

The vacuum control change-over valve 30 includes control chambers 34 and 35, and their ports 36 and 37 are opened and closed by switch valves 38 and 39 that are integral with the diaphragm 32.

Reference numeral 40 represents the throttle of the vacuum passage 29.

In this embodiment, the bellows 2 contracts when the engine is started cold at a low altitude The lead valves 61 and 62 close the bleed ports 51 and 52, and the operation rod 80 pulls up the lead valve 60 to open the communication port 50. Thus, the vacuum passage 29 is communicated with the atmospheric chamber 70 via the communication port 50, and the vacuum of the intake manifold 18 does not act upon the vacuum chamber 33 of the vacuum control chamber-over valve 30. Consequently, the diaphragm 32 is pushed by the spring 31 and pushes in turn the valves 38 and 39, thereby closing the ports 36 and 37.

After the engine has warmed up, the auxiliary passage 22 is closed by the thermosensitive operation valve 26, and the spring 31 keeps pushing the switch valves 38 and 39, while keeping the ports 36 and 37 closed.

Whether the engine is cold or warmed up, therefore, bleed air is not delivered to the primary main air bleed port 12 and to the slow air bleed passage 13 and the drivability as well as the treatment of exhaust gas are both stable with the air-fuel ratio set for low altitudes.

When the car moves to a higher altitude, the bellows 2 expands and the operation rods 80, 81 and 82 lower in proportion to the altitude. Consequently, the lead valve 60 of the vacuum chamber 70' is closed and the lead valves 61 and 62 open the bleed ports 51 and 52. As a result, bleed air is delivered to the primary main air bleed port 12 and to the slow air bleed port 13 with the characteristics P1 of FIG. 8.

On the other hand, the vacuum from the intake manifold also acts upon the vacuum chamber 70' of the main body 3'' of the compensation apparatus via the check valve 28, but since the vacuum chamber 70' is cut off from the atmospheric chamber by the lead valve 60, the vacuum reaches the thermosensitive operation valve 26 via the vacuum passage 29'.

While the engine is cold, the passage of the thermosensitive operation valve 26 is kept open. Hence, the vacuum acts upon the vacuum chamber 33 of the vacuum control change-over valve 30 and the diaphragm valve 32 is drawn and lowered against the force of the spring 31 so that the switch valves 38 and 39, that are integral with the diaphragm 32, are opened.

As a result, the auxiliary passages 22 and 23 are fully open and bleed air is supplied from the filter 7 and joins the bleed air to be fed to the passages 16 and 17 from the main body 3'' of the compensation apparatus, thereby increasing the quantity of air as represented by P2'' in FIG. 8. Hence, the air-fuel ratio does not become rich even when the engine is driven cold, and drivability and treatment of exhaust gas can be stabilized.

When the engine warms up, the thermosensitive operation valve 26 closes in the above-mentioned manner and cuts off the introduction of the vacuum to the vacuum control change-over valve 30. The ports 36 and 37 are closed to cut off the communication between the auxiliary passages 22, 23 and the air filter 7, cutting off the feed of bleed air to the auxiliary passages and ensuring stability of drivability when the engine is warm, and stable treatment of exhaust gas.

The throttle 41 of the vacuum chamber 33 is set to be sufficiently smaller than the throttle 40. The throttle 41 operates in such a manner that when the vacuum is fed to the vacuum chamber when the engine is cold, it minimizes the influences that would reduce the vacuum, and after the engine warms up, it plays the role of bleeding the vacuum to the atmosphere lest the thermosensitive operation valve should close the vacuum chamber with the vacuum remaining inside.

In the fourth embodiment of the present invention, a diaphragm valve 612 having a return spring 311 is disposed inside the casing 4''' of the main body 3''' of the compensation apparatus and is normally seated on and sealing the inlet of a connection passage 167 of the passages 16 and 17 having the fixed throttles 14 and 15 for determining the set air bleed quantity at the ports 12 and 13 of the main air bleed port 10 and slow air bleed port 11 as the intake system of the fuel passage 9 of the carburetor 8.

The vacuum chamber 712 of the diaphragm valve 612 is communicated with the intake manifold 18 of the carburetor 8 by the control passage 29 having the throttle 40 and the check valve 28 interposed in the passage.

The bellows 2, which is disposed in the air filter 7 of the casing 4''' and charged with the set atmospheric pressure, is set in such a fashion as to close the intake port 512 of the diaphragm valve 612 below the set pressure.

In addition to the abovementioned construction, this embodiment also includes the thermosensitive operation valves 26 and 27 of the bimetal sensor-type. These valves are exposed to engine cooling water and are disposed in the auxiliary passages 22 and 23 that are branched downstream and upstream of the fixed throttles 14 and 15, which operate after the engine warms up. The apparatus also includes the throttles 24 and 25 for when the engine is driven cold.

In the abovementioned construction, when the engine is warmed up, the thermosensitive operation valves 26 and 27 sense the temperature rise of the water and cut off the auxiliary passages 22 and 23 so that only the passages 16 and 17 function as the air bleed passages. At low altitudes, the bellows 2 is contracted, the diaphragm valve 612 is pushed by the return spring 311 to close the inlet of the passage 167, and the intake port 512 is open. The intake manifold vacuum is sucked through the control passage 29 into the atmosphere via the air filter 7. Accordingly, no compensation air bleed is applied to the intake system and the engine can be driven at the set air-fuel ratio.

On the other hand, when the car moves toward higher altitudes and the atmospheric pressure drops below the set pressure, the bellows 2 expands to close the intake port 512 and the intake manifold vacuum acts upon the vacuum chamber 712. The diaphragm valve 612 is then pulled against the return spring 311 and the inlet of the passage 167 is opened and atmospheric air from the air filter 7 is supplied to the main air bleed port 12 and to the slow air bleed port 13 through the throttles 14 and 15, thereby bleeding air corresponding to the pressure difference with respect to the atmospheric pressure at low altitude and preventing the air-fuel ratio from becoming over-rich. Accordingly, both drivability and the treatment of exhaust gas can be stabilized.

When the car is driven while the engine is cold at a high altitude, the thermosensitive operation valves 26 and 27 sense the cooling state of the engine and open the auxiliary passages 22 and 23. Because the pressure is low in driving while the engine is cold, the bellows 2 close the intake port 512 and the diaphragm valve 612 opens the inlet of the passage 167 by means of the intake manifold vacuum simultaneously with cranking. The air from the air filter 7 is fed from the passage 167 to the passages 16 and 17 and also to the branch auxiliary passages 22 and 23 and passes through the fixed throttles 14, 15 and 24, 25. Accordingly, the bleed air is supplied in a set quantity which is greater by the quantity determined by the latter valves 24, 25 than in the case of driving with the engine warm. For this reason, the air-fuel ratio in driving with the engine cold is prevented from becoming rich and the engine is driven at the set air-fuel ratio. Hence, both drivability and treatment of exhaust gas can be stabilized as originally designed.

As the engine is gradually warmed up, the thermosensitive operation valves 26 and 27 sense the temperature rise and close the auxiliary passages 22 and 23, thereby cutting off the air bled through throttles 24 and 25. Hence, the air bleed shifts to the set air bleed quantity by the throttles 14, 15 after the engine warm-up, and smooth air bleed is maintained from when the engine is started cold until it is warmed up, ensuring smooth drivability and treatment of the exhaust gas.

Figure 9:
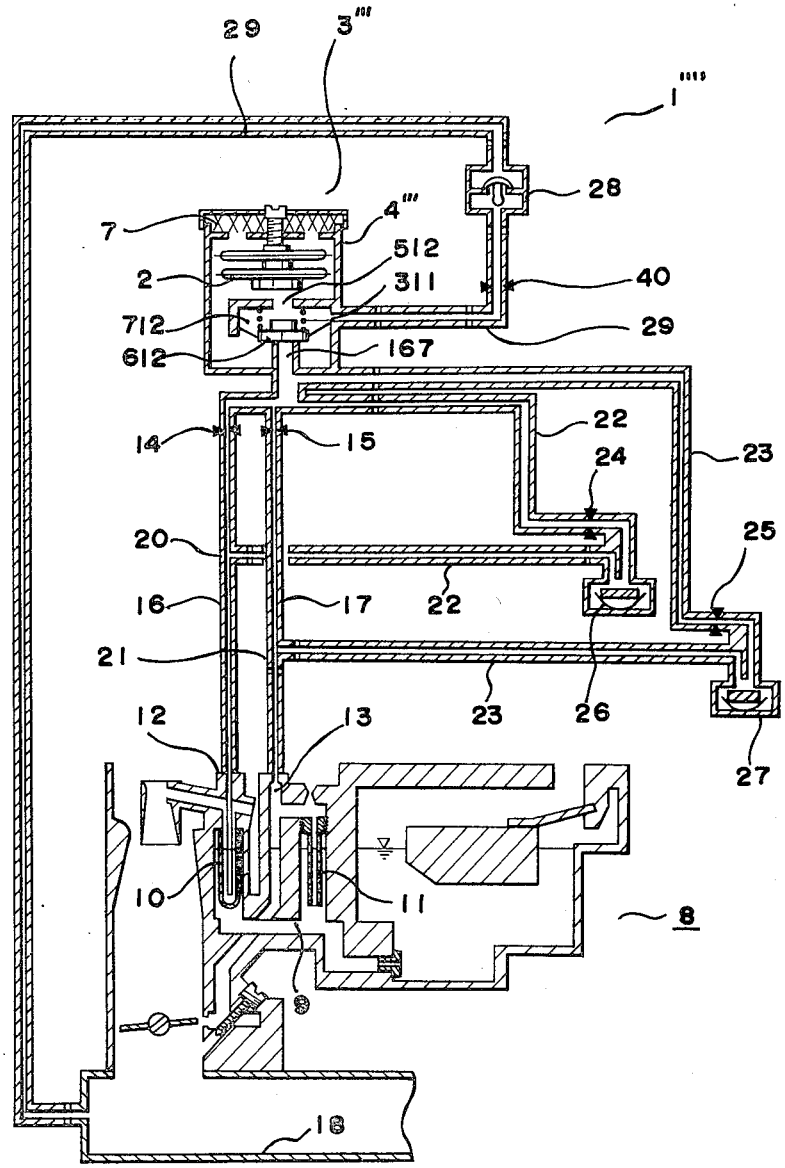
FIG. 9 is a sectional view of a fourth embodiment.
Figure 10:
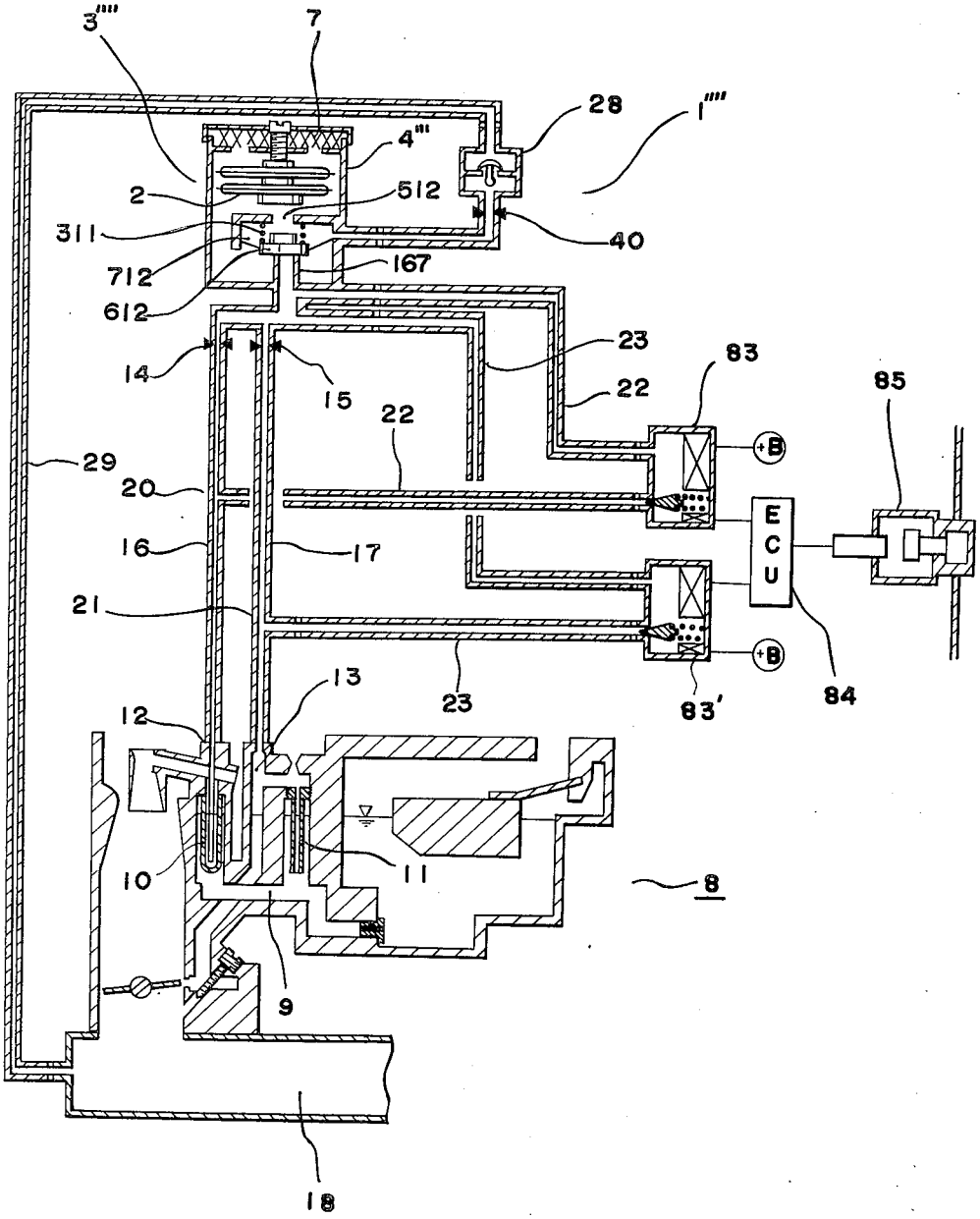
FIG. 10 is a sectional view of a fifth embodiment.

In still another embodiment of the invention shown in FIG. 10, the main body 3'''' of the altitude compensation apparatus 1'''', the passages 16, 17 having the fixed throttles 14, 15, the auxiliary passages 22, 23, and the carburetor 8 are substantially the same as those of the embodiment shown in FIG. 9, but additional electromagnetic variable throttles 83 and 83' are interposed in the auxiliary passages 22 and 23. The electromagnetic coils of these valves 83, 83' are connected to a known engine water temperature sensor 85 via a microcomputer 84. The throttles function as the switch valves and also as the throttles. When the temperature is below the set water temperature, that is, when driving while the engine is cold, the electromagnetic variable throttles 83 and 83' open a set amount to bleed air and are closed after the engine warms up, thereby cutting off the auxiliary air bleed.

Incidentally, the embodiments of the invention are not limited to those described in the foregoing, in particular. For example, wax type thermosensitive operation valves that operate linearly may be used to continuously change the bleed quantity without any steps, and various other embodiments may be used.

As described in the foregoing, in an altitude compensation apparatus to be fitted to a carburetor, the present invention feeds additional bleed air to auxiliary passages branching from and connected to the passages between the air bleed ports of the carburetor and the main body of the compensation apparatus by means of thermosensitive operation valves when the engine is cold. Fundamentally, the present invention supplies supplementary bleed air until the engine warms up so as to keep a suitable air-fuel ratio when the engine is cold, when it would otherwise become over-rich depending upon conditions such as the choke operation. Thus, the apparatus of the invention provides the excellent effects that drivability can be stabilized and treatment of the exhaust gas can be smoothly carried out.

Moreover, the auxiliary air bleed when the engine is cold is effected completely automatically only when driving with the engine cold at high altitudes but does not at all affect driving with the engine cold at low altitudes.

In accordance with the present invention, the flow rate control valves are disposed between the passage of the compensation apparatus and the auxiliary passages so as to come into and out of contact with the operation rods integrated with the bellows charged with the atmospheric pressure in the main body of the compensation apparatus. Accordingly, the air bleed for compensating for the altitude is effected in proportion to the altitude, i.e. with the decreasing concentration of the atmospheric air, and the quantity of auxiliary bleed air while the engine is cold is also proportional to the altitude. Moreover, if continuous operation type thermosensitive operation valves are used, the auxiliary air bleed can be continuously controlled without any steps while driving with a cold engine from when the engine starts to warm up until the engine is warmed up substantially.

If the configuration of the operation rods is designed so that their operation timing with respect to the flow rate control valves on the side of the auxiliary air bleed is effected at the set altitude, the altitude range of the auxiliary air bleed operation for a cold engine can be set in advance independently of the general altitude for the altitude compensation.

If the configuration of the operation rods for the main compensation air bleed flow rate control valves and the configuration of the operation rods for the compensation air bleed flow rate control valves are set so that they operate in synchronism with each other, the additional compensation air bleed when the engine is cold can be always effected during the altitude compensation operation.

Furthermore, in the apparatus of the present invention, the auxiliary passages branching from the passages are communicated with the atmosphere via the air filter, the negative pressure control change-over valves are disposed at intermediate portions of the auxiliary passages and, the vacuum chambers of the vacuum control change-over valves are communicated with the vacuum chamber of the main body of the compensation apparatus having the flow rate control valves. According to this arrangement, the auxiliary air bleed operation is fundamentally controlled by the vacuum control change-over valves that operate in accordance with the altitude so that the pressure change with the changes in altitude can be introduced step-wise, and the auxiliary air bleed can be controlled step-wise. Hence, this arrangement is suitable for a design in which a change of the air-fuel ratio in driving with the engine cold at high altitude is not desired.

What is claimed is:

1. An altitude compensation device for a carburetor, comprising:

(a) a chamber in communication with the atmosphere;

(b) air bleed port means for conducting atmosphere from said chamber;

(c) a primary conduit in fluid communication with said air bleed port means providing fluid communication between said chamber and the fuel system of said carburetor;

(d) first valve means responsive to changes in atmospheric pressure for opening and closing said air bleed port means;

(e) a first flow restrictor in said primary conduit immediately downstream of said air bleed port means;

(f) an auxiliary conduit providing fluid communication between an atmospheric pressure source and said primary conduit, said auxiliary conduit communicating with said primary conduit at a junction downstream of said first flow restrictor and upstream of said carburetor fuel system;

(g) second valve means responsive to changes in atmospheric pressure for controlling communication between said auxiliary conduit and said atmospheric pressure source;

(h) a second flow restrictor in said auxiliary conduit downstream of said atmospheric pressure source and upstream of said junction; and (i) thermosensitive valve means responsive to engine temperature for permitting fluid flow through said auxiliary conduit when engine temperature is below a predetermined level and for preventing fluid flow through said auxiliary conduit when engine temperature is above said predetermined level.

2. The altitude compensation device of claim 1 wherein said air bleed port means comprises a first port means for fluid communication between said chamber and said primary conduit.

3. The altitude compensation device of claim 2 wherein said first valve means comprises:

(a) first normally closed flexible valve means for controlling fluid flow through said first port means;

(b) a bellows disposed in said chamber for expansion and contraction in response to changes in atmospheric pressure; and (c) first operation rods secured to said bellows for movement therewith, said first rods opening said first flexible valve means when atmospheric pressure is below a predetermined level.

4. The altitude compensation device of claim 3 wherein said atmospheric pressure source is said chamber and wherein said auxiliary conduit communicates with said chamber through said air bleed port means.

5. The altitude compensation device of claim 4 wherein said air bleed port means also includes a second port means for fluid communication between said chamber and said auxiliary conduit.

6. The altitude compensation device of claim 5 wherein said second valve means comprises second normally closed flexible valve means for controlling fluid flow through said second port means, said bellows, and second operation rods secured to said bellows for movement therewith, said second rods opening said second flexible valve means when atmospheric pressure is below a predetermined level.

7. The altitude compensation device of claim 6 wherein said first and second operation rods are disposed for simultaneously operating said first and second flexible valve means.

8. The altitude compensation device of claim 6 wherein said first and second operation rods are disposed for staged operation of said first and second flexible valve means.

9. The altitude compensation device of claim 8 wherein said first flexible valve means is opened before and closed after second flexible valve means.

10. The altitude compensation device of claim 3 wherein said atmospheric pressure source is a valve chamber in fluid communication with the atmosphere and with said auxiliary conduit.

11. The altitude compensation device of claim 10 wherein said second valve means comprises:

(a) third valve means disposed in said valve chamber for selectively interrupting fluid communication between the atmosphere and said auxiliary conduit;

(b) a diaphragm operatively connected to said third valve means, said diaphragm defining a vacuum chamber in said valve chamber;

(c) means in said valve chamber for biasing said diaphragm to normally close said third valve means;

(d) vacuum conduit means selectively communicating engine generated vacuum to said vacuum chamber for selectively opposing said biasing means to open said third valve means; and (e) means responsive to changes in atmospheric pressure for introducing atmospheric pressure into said vacuum conduit means when atmospheric pressure is above a predetermined level.

12. The altitude compensation device of claim 11 wherein said introducing means comprises an orifice providing fluid communication between said chamber and said vacuum conduit means, third normally closed flexible valve means for controlling fluid flow through said orifice, and a third operating rod secured to said bellows for movement therewith and disposed to open said third flexible valve means when atmospheric pressure is above a predetermined level.

13. The altitude compensation device as in either of claims 11 or 12 wherein said thermosensitive valve means is disposed in said vacuum conduit means for interrupting communication of vacuum to said vacuum chamber when engine temperature is above said predetermined level.

14. An altitude compensation device for a carburetor, comprising:

(a) a chamber in communication with the atmosphere;

(b) an air bleed port for conducting atmosphere from said chamber;

(c) a primary conduit in fluid communication with said air bleed port providing fluid communication between said chamber and the fuel system of said carburetor;

(d) a first flow restrictor in said primary conduit downstream of said air bleed port;

(e) an auxiliary conduit providing fluid communication between a first point in said primary conduit upstream of said restrictor and a second point in said primary conduit downstream of said restrictor;

(f) valve means in said chamber for opening and closing said air bleed port in response to changes in atmospheric pressure; and (g) thermosensitive valve means responsive to engine temperature for permitting fluid flow through said auxiliary conduit when engine temperature is below a predetermined level and for preventing fluid flow through said auxiliary conduit when engine temperature is above said predetermined level.

15. The altitude compensation device as in claim 14 wherein said valve means comprises a first valve disposed in said chamber and defining a vacuum chamber having a first port communicating with said chamber, means in said vacuum chamber biasing said first valve to normally close said bleed port, means communicating engine generated vacuum to said vacuum chamber, a bellows disposed in said chamber for expansion and contraction in response to changes in atmospheric pressure, and a second valve secured to said bellows for movement therewith, said second valve closing said first port when atmospheric pressure is below a predetermined level thereby increasing vacuum in said vacuum chamber to move said first valve against said biasing means and opening said air bleed port to the atmosphere in said chamber.

16. The altitude compensation device as in either of claims 1 and 14 wherein said thermosensitive valve means comprises a thermosensitive valve responsive to engine coolant temperature.

17. The altitude compensation device as in either of claims 1 and 14 wherein said thermosensitive valve means comprises an electromagnetic valve controlled by signals from an engine temperature sensor.

18. The altitude compensation device of claim 15 also including a second flow restrictor in said auxiliary conduit.

19. The altitude compensation device of claim 14, wherein said thermosensitive valve means comprises an electromagnetic valve controlled by signals from an engine temperature sensor and wherein said electromagnetic valve includes a restrictor of flow through said auxiliary conduit.

* * * * *